US005427365A

United States Patent [19]

Torisawa

[11] Patent Number: 5,427,365

[45] Date of Patent: Jun. 27, 1995

[54] METHOD AND MECHANISM FOR FEEDING SHEETS

[75] Inventor: Nobuyuki Torisawa, Minamiashigara, Japan

[73] Assignee: Fuji Photo Film Co., Ltd., Tokyo, Japan

[21] Appl. No.: 70,804

[22] Filed: Jun. 3, 1993

[30] Foreign Application Priority Data

Jun. 5, 1992 [JP] Japan ..... 4-145609
Jun. 5, 1992 [JP] Japan ..... 4-145610
Oct. 7, 1992 [JP] Japan ..... 4-268974

[51] Int. Cl.[6] ..... B65H 5/08

[52] U.S. Cl. ..... 271/11; 271/107; 271/106; 271/108

[58] Field of Search ..... 271/11, 107, 106, 105, 271/108

[56] References Cited

U.S. PATENT DOCUMENTS 3,458,042 7/1969 Mestre ..... 271/11
4,848,764 7/1989 Tajima et al. ..... 271/107 X
5,253,855 10/1993 Torisawa et al. ..... 271/11 X

FOREIGN PATENT DOCUMENTS 0488316 6/1992 European Pat. Off. ..... 271/11
1122841 5/1989 Japan ..... 271/11

*Primary Examiner*—David H. Bollinger
*Attorney, Agent, or Firm*—Sughrue, Mion, Zinn, Macpeak & Seas

[57] ABSTRACT

Sheets such as photographic films are fed, one by one, from a stack of sheets on a sheet support to a sheet delivery mechanism. Suction cups for attracting an uppermost sheet of the stack are moved toward the stack, and activated to attract the uppermost sheet. The suction cups are then moved to remove the uppermost sheet from the stack while the suction cups are being inclined a predetermined angle from a direction perpendicularly to the uppermost sheet toward opposite to a direction in which the sheet is fed. The removed uppermost sheet is then transferred to the sheet delivery mechanism in the direction in which the sheet is fed.

11 Claims, 17 Drawing Sheets

METHOD AND MECHANISM FOR FEEDING SHEETS

BACKGROUND OF THE INVENTION

1. Field of the Invention

The present invention relates to a method and a mechanism for feeding sheets, one by one, from a sheet stack to a predetermined location.

2. Description of the Related Art

Sheet feeders are employed to feed stacked sheets, e.g., photosensitive sheets such as photographic films, to an exposure position or to feed sheets with images recorded thereon to an image developing position.

Such a sheet feeder usually comprises a plurality of suction cups coupled to a vacuum generator. The suction cups are pressed against an uppermost one of stacked sheets, attract the sheet under a vacuum developed in the suction cups, remove the sheet from the sheet stack, and deliver the sheet to a sheet delivery mechanism.

When the uppermost sheet is drawn by the suction cups, one or more sheets beneath the uppermost sheet tend to stick to the uppermost sheet, and to be removed simultaneously from the sheet stack. To prevent a plurality of sheets from being fed at the same time, the suction cups as they attract the uppermost sheet are angularly and/or linearly moved to give a swinging motion to the sheet.

However, the sheet feeder capable of giving a swinging motion to the sheet while it is being fed by the suction cups is relatively complex in structure, and highly costly to manufacture. Since the sheet attracted by the suction cups is moved along an intricate path for swinging movement, it takes a relatively long period of time to feed the sheet from the sheet stack, failing to feed the sheets efficiently.

The sheet delivery mechanism has a pair of feed rollers held in rolling contact with each other. After the leading end of a sheet attracted by the suction cups is inserted between the feed rollers, the feed rollers are rotated to deliver the sheet to a predetermined position, e.g., toward an automatic image developing apparatus.

The suction cups of the sheet feeder are not capable of attracting the leading end of the sheet. Therefore, when the sheet is attracted by the suction cups, the leading end thereof is liable to flex downwardly due to gravity. Inserting the leading end of the attracted sheet between the feed rollers requires that the position of the suction cups be controlled with high accuracy. Thus, the process of controlling the position of the suction cups becomes considerably complex. Another problem is that if the leading end of the sheet attracted by the suction cups is curled, it cannot smoothly be inserted between the feed rollers.

One solution has been to employ a sheet delivery. mechanism comprising a feed roller and a swingable nip roller. This sheet delivery mechanism operates as follows: After the suction cups which attract a sheet have moved beyond the feed roller, the nip roller is angularly displaced from the trailing end of the sheet to nip the sheet between the feed roller and the nip roller, and the feed roller and the nip roller cooperate with each other to feed the sheet.

The sheet delivery mechanism, however, needs a dedicated actuator for swinging the nip roller in addition to an actuator for moving the suction cups. Consequently, the overall sheet feed assembly is highly complex and expensive. Furthermore, inasmuch as it is necessary to move the suction cups beyond the feed roller to a position forwardly of the feed roller, the distance that is traversed by the suction cups is relatively large. The relatively large distance traversed by the suction cups results in a reduction in the efficiency with which the sheets are fed one by one.

SUMMARY OF THE INVENTION

It is therefore the object of the present invention to provide a method and a mechanism for feeding sheets reliably and quickly one by one from a sheet stack, and supplying the removed sheets smoothly to a sheet delivery mechanism, the feeding mechanism being relatively simple in structure.

According to the present invention, there is provided a method of feeding sheets one by one from a stack of sheets to a sheet delivery mechanism, comprising the steps of moving suction means for attracting a sheet toward an uppermost sheet of the stack, attracting the uppermost sheet with the suction means, moving said suction means which attracts the uppermost sheet to remove the uppermost sheet from the stack in a direction inclined a predetermined angle from a direction perpendicular to the uppermost sheet toward opposite to a sheet feeding direction, and transferring the uppermost sheet removed from the stack to the sheet delivery mechanism in the sheet feeding direction.

According to the present invention, there is also provided a mechanism for feeding sheets one by one from a stack of sheets to a sheet delivery mechanism, comprising suction means for attracting an uppermost sheet of the stack, moving means for moving the suction means which attracts the uppermost sheet in a direction inclined a predetermined angle from a direction perpendicular to the uppermost sheet toward opposite to a sheet feeding direction in which the sheets are fed to the sheet delivery mechanism, and transferring means for transferring the uppermost sheet removed from the stack to the sheet delivery mechanism in the sheet feeding direction.

According to the present invention, there is further provided a mechanism for feeding sheets one by one from a stack of sheets to a sheet delivery mechanism, comprising: suction means for attracting an uppermost sheet of the stack; moving means for moving the suction means which attracts the uppermost sheet; transferring means for transferring the uppermost sheet attracted by said suction means to the sheet delivery mechanism; and a press roller which moves in unison with the suction means and nips and delivers the uppermost sheet in cooperation with a feed roller of the sheet delivery mechanism.

In the above mechanism according to the invention, the moving means may comprise a movable base moving up and down in the direction in which the moving means moves said suction means, and a swingable member swingably mounted on the movable base, for holding the suction means with a suction face thereof lying parallel to said uppermost sheet. The transferring means may comprise a presser roller mounted on the swingable member, the press roller moving with the suction means and coacting with a feed roller of the sheet delivery mechanism to nip and deliver the uppermost sheet.

In the above mechanism according to the invention, the moving means may also comprise an attachment member which is movable between the stack of sheets and the sheet delivery mechanism, to which the suction means is mounted, and guide means for guiding the attachment member along a predetermined path. The transferring means may also comprise a press roller mounted on the attachment for moving with the suction means and coacting with a feed roller of the sheet delivery mechanism to nip and deliver the uppermost sheet, and attitude keeping means for holding the attachment in a predetermined attitude with respect to the guide means to guide the uppermost sheet attracted by the suction means to a position in which the uppermost sheet can be nipped by the press roller and feed roller.

With the arrangement of the present invention, the suction means that has attracted the uppermost sheet is moved while they are being inclined through a certain angle from the direction perpendicular to the sheet toward opposite to the sheet feeding direction. Therefore, the leading end of the sheet attracted by the suction means is displaced toward the trailing end thereof, so that the sheet is flexed between its leading and trailing ends. The sheet held by the suction means is given a swinging motion through simple movement of the suction means. Plural sheets are thus reliably and easily prevented from being fed simultaneously.

Furthermore, after the uppermost sheet has been attracted by the suction means, the movable base or the attachment member is moved to move the suction means and the sheet toward the sheet delivery mechanism. The press roller is also moved with the suction means toward the feed roller of the sheet delivery mechanism. The sheet is quickly and reliably nipped between the feed roller and the press roller. The sheet feeding mechanism is thus capable of feeding sheets one by one efficiently. The above and other objects, features, and advantages of the present invention will become apparent from the following description when taken in conjunction with the accompanying drawings which illustrate preferred embodiments of the present invention by way of example.

DETAILED DESCRIPTION OF THE PREFERRED EMBODIMENTS

Figure 1:
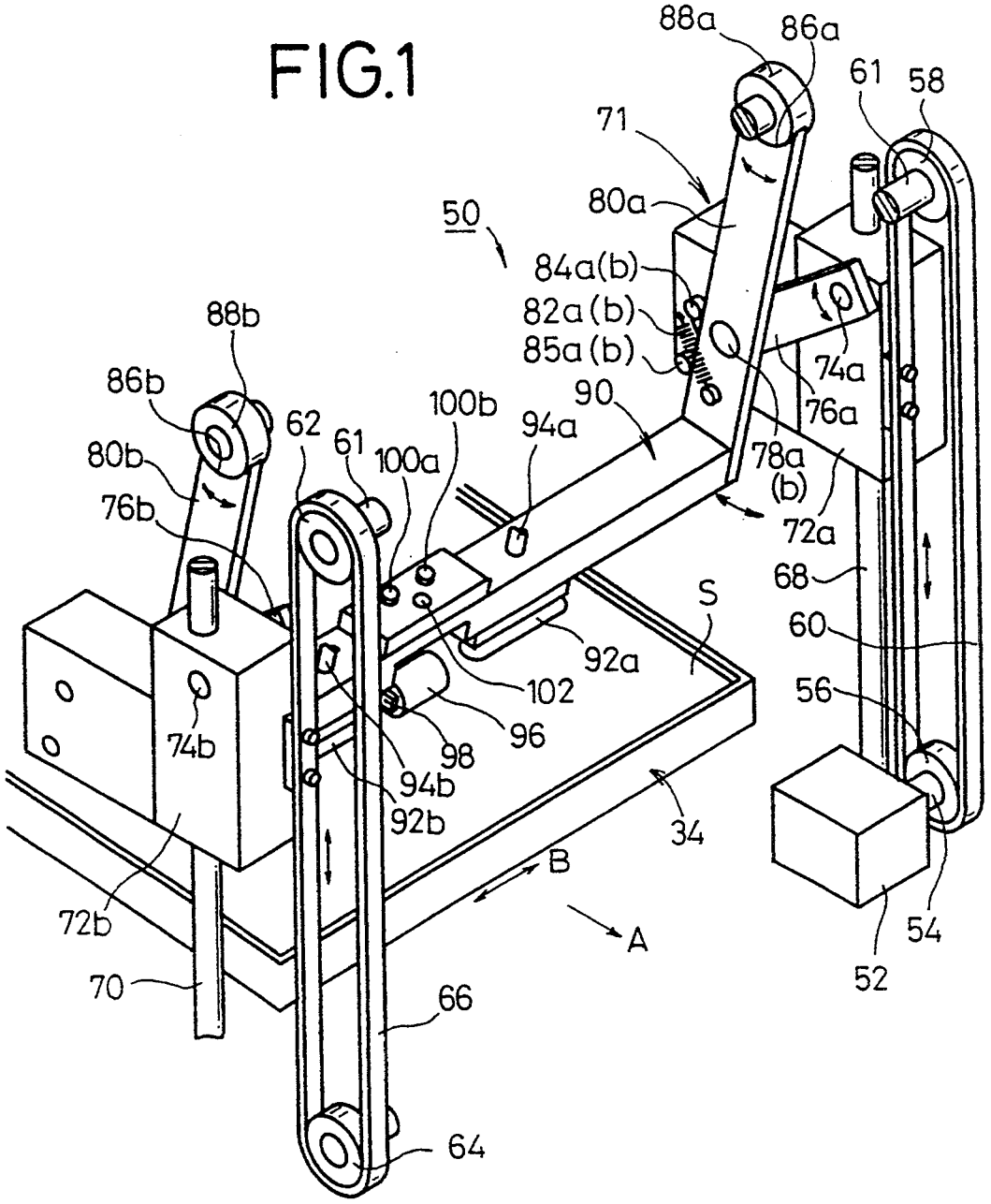
FIG. 1 is a perspective view of a sheet feeding mechanism according to a first embodiment of the present invention.
Figure 2:
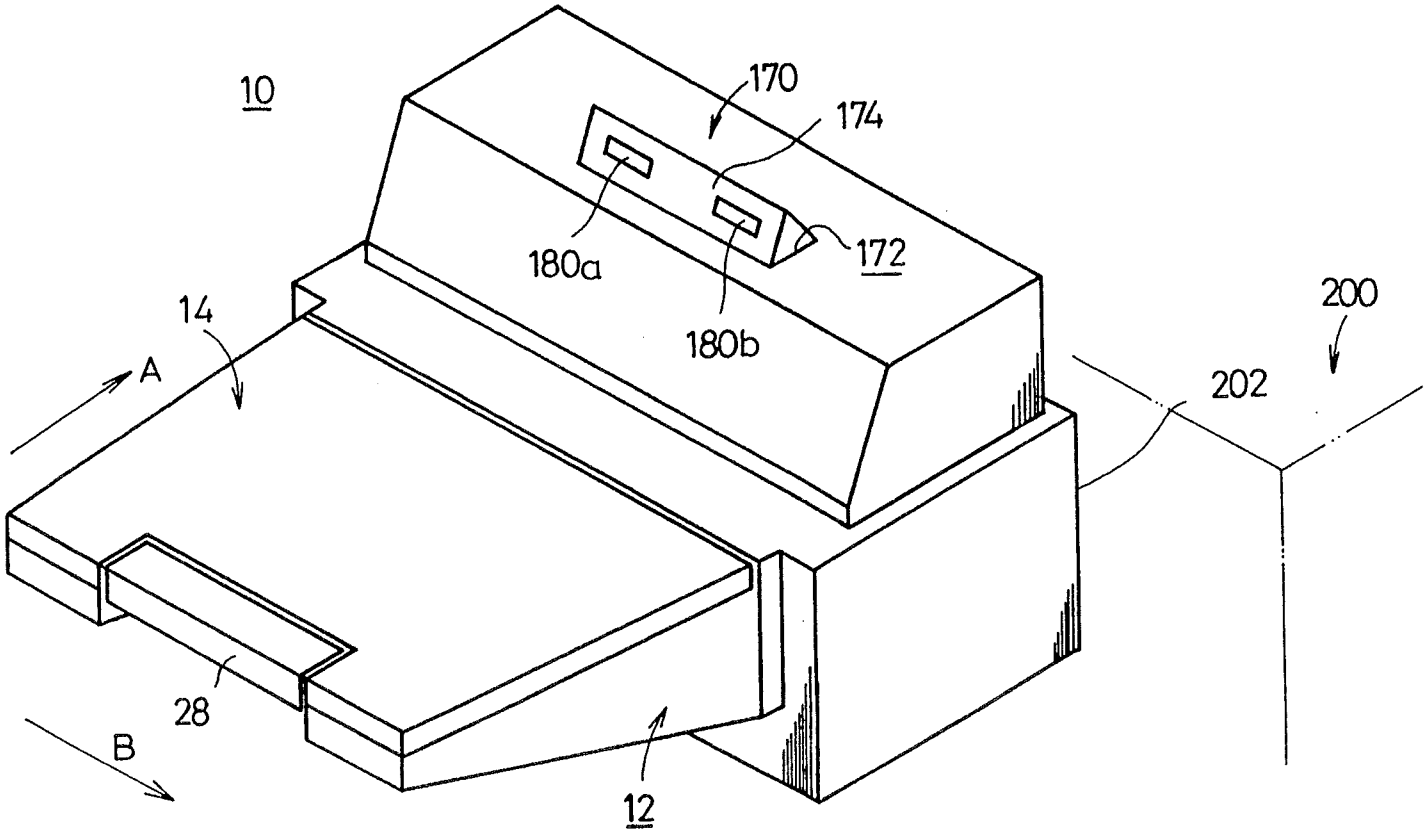
FIG. 2 is a perspective view of an automatic supply device incorporating the sheet feeding mechanism of the invention therein.
Figure 3:
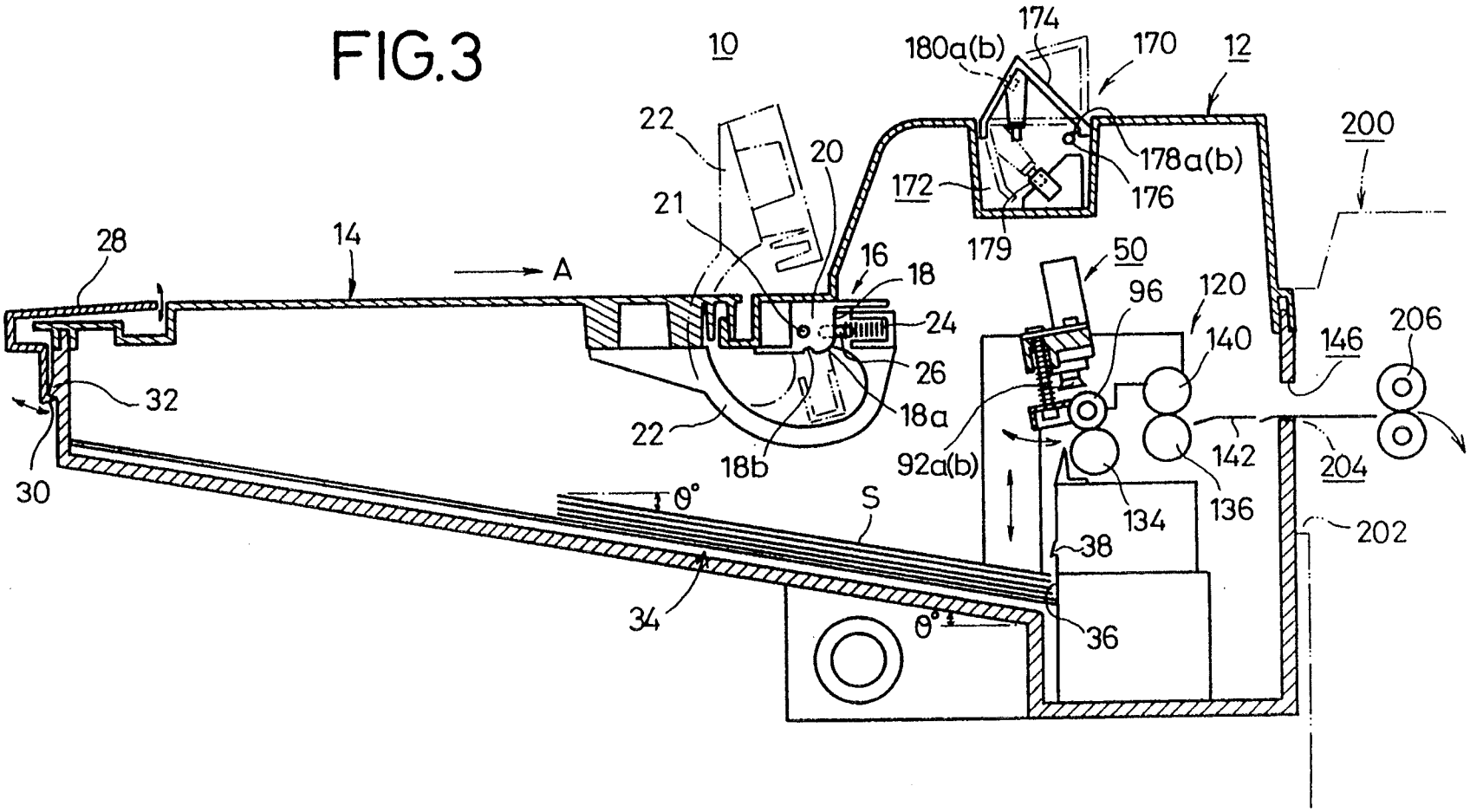
FIG. 3 is a vertical cross-sectional view of the automatic supply device shown in FIG. 2.

A sheet feeding mechanism according to a first embodiment of the present invention, as shown in FIG. 1, is incorporated in an automatic supply device 10 shown in FIGS. 2 and 3.

As shown in FIGS. 2 and 3, the automatic supply device 10 has a casing 12 with a cover 14 swingably mounted on a front upper portion of the casing 12 by an opening and closing mechanism 16. The opening and closing mechanism 16 comprises a pair of cams 20 (one shown) spaced from each other and fixedly positioned in the casing 12, a pair of attachment members 22 (one shown) fixed to a rear end of the cover 14 for angular movement about a pivot shaft 21, and a pair of pins 26 (one shown) supported on the respective attachment members 22 and normally urged by respective springs 24 into sliding contact with arcuate cam surfaces 18 of the cams 20. When each of the pins 26 is positioned between the solid-line position and a cam lobe **18*a* of the cam surface 18, the spring 24 biases the attachment member 22 in a direction to close the cover 14. When the pin 26 is positioned between the cam lobe 18*a* and a locking recess 18*b* in the cam surface 18, the spring 24 biases the attachment member 22 in a direction to open the cover 14 as indicated by the two-dot-and-dash lines in FIG. 3**.

A lock member 28 is swingably mounted on a front end of the cover 14. The lock member 28 has a locking prong 30 lockingly engageable with a locking prong 32 on a front panel of the casing 12 to lock the cover 14 to the casing 12.

Figure 4:
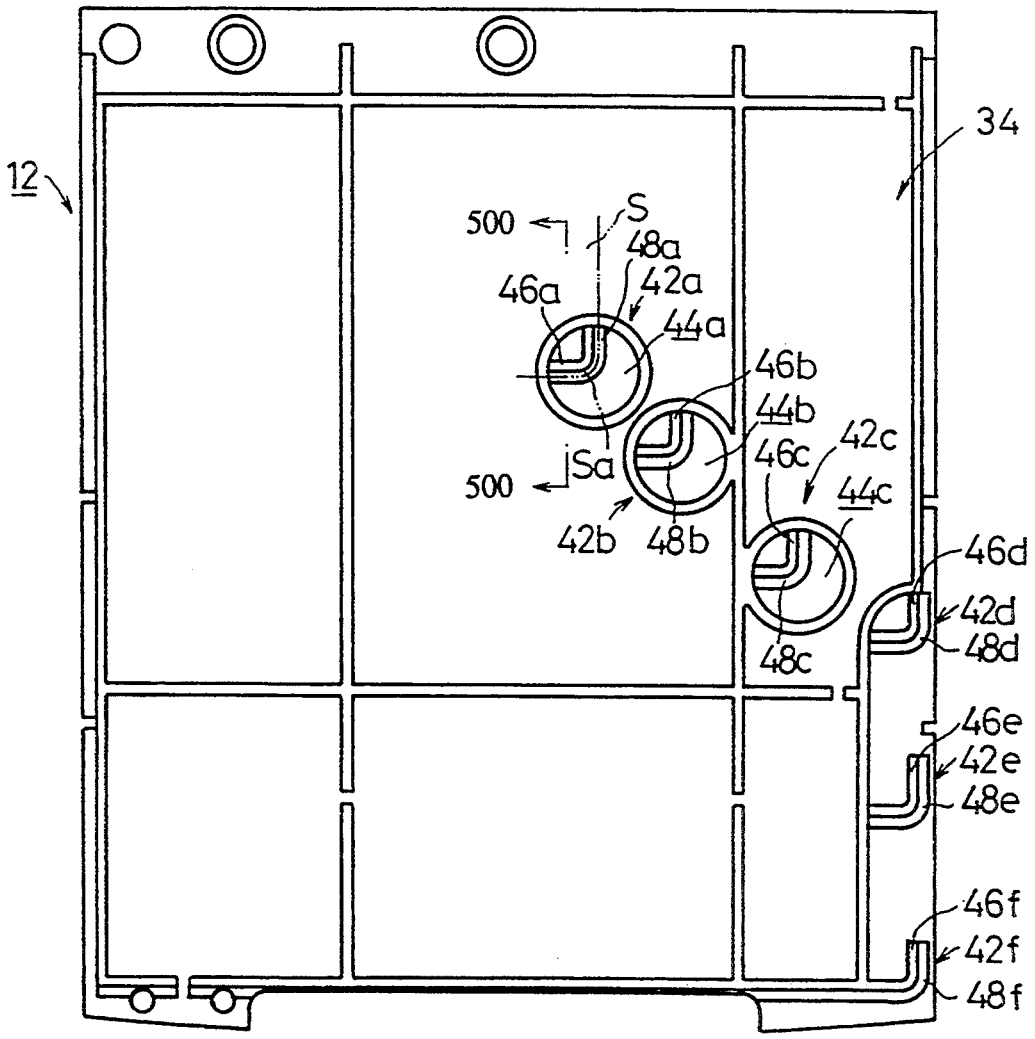
FIG. 4 is a plan view of a sheet support of the automatic supply device.

A sheet support 34 is disposed on the bottom of the casing 12 which is positioned below and openable and closable by the cover 14. The casing 12 houses a vertical wall 36 located at a forward end of the sheet support 34 with respect to the direction, indicated by the arrow A, in which sheets are fed. The vertical wall 36 has an engaging prong 38 at a certain vertical position thereon. The sheet support 34 is inclined at a certain angle 8°, practically ranging from 5° to 45°, preferably 10°, with respect to the horizontal direction. The sheet support 34 has a plurality of positioning members **42*a* through 42*f* (see FIG. 4**) for positioning sheets S, e.g., photosensitive sheets such as photographic films, of different dimensions.

Figure 5:
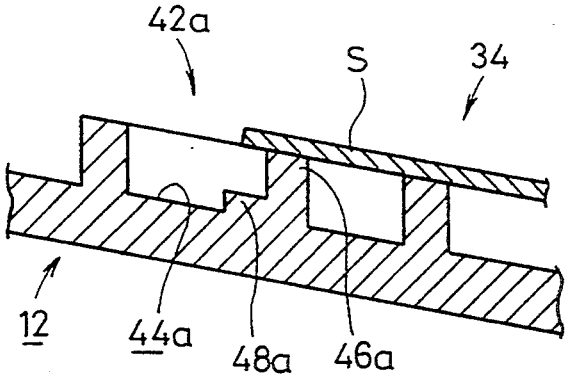
FIG. 5 is a cross-sectional view taken along line 500—500 of FIG. 4.

The positioning member **42*a* comprises a first angular profile wall 46*a* disposed in a circular cavity 44*a* defined in the sheet support 34 and positioned at dimensions smaller than those of a sheet S which is positionable by the positioning member 42*a*, and a second angular profile wall 48*a* disposed in the circular cavity 44*a* outwardly of the first profile wall 44*a*. The second angular profile wall 48*a* is lower than the first angular profile wall 46*a*. The second angular profile wall 48*a* is positioned such that the profile or edge of a corner Sa (see FIG. 4) of the sheet S positionable by the positioning member 42***a* is located within the width of the second angular profile wall 48*a* as shown in FIG. 5.

The other positioning members 42*b* through 42*f* are identical in structure to the positioning member 42*a* except that the positioning members 42*b* through 42*f* are positioned at dimensions corresponding to other sheets S that are positionable by the positioning members 42*b* through 42*f*. Parts of the positioning members 42*b* through 42*f* which are identical to those of the positioning member 42*a* are denoted by an identical reference numeral with suffixes b through f, and will not be described in detail below.

The casing 12 accommodates the sheet feeding mechanism, denoted at 50, according to the first embodiment for feeding sheets S on the sheet support 34, one by one, to a sheet delivery mechanism (described later on). As shown in FIG. 1, the sheet feeding mechanism 50 has a rotary actuator 52 having a rotatable shaft 54 with a pulley 56 fixedly mounted on an outer end thereof. A timing belt 60 is vertically trained around the pulley 56 and another pulley 58 that is positioned upwardly of the pulley 56. The pulley 58 is fixed to an end of a rotatable shaft 61 whose opposite end supports a pulley 62 fixed thereto. Another timing belt 66 is vertically trained around the pulley 62 and another pulley 64 positioned below the pulley 62, the timing belt 66 extending parallel to and being spaced from the timing belt 60. Guide rods 68, 70 are vertically disposed closely and parallel to the timing belts 60, 66, respectively. The guide rods 68, 70 extend respectively through vertically movable bases 72*a*, 72*b* fastened to the timing belts 60, 66, respectively, the vertically movable bases 72*a*, 72*b* jointly serving as a moving assembly 71.

Narrow plate members 76*a*, 76*b* are pivotally supported at their one end on the vertically movable bases 72*a*, 72*b*, respectively, by pivot shafts 74*a*, 74*b*. Pins 78*a*, 78*b* are inserted respectively through the opposite ends of the narrow plate members 76*a*, 76*b*, and fixed to respective swingable bars 80*a*, 80*b*. Tension springs 82*a*, 82*b* have opposite ends secured to the swingable bars 80*a*, 80*b* and the vertically movable bases 72*a*, 72*b*. Stopper pins 84*a*, 84*b* and stopper pins 85*a*, 85*b* are fixed to the vertically movable bases 72*a*, 72*b*. Under the bias of the tension springs 82*a*, 82*b*, the narrow plate members 76*a*, 76*b* are normally held in engagement with the stopper pins 84*a*, 84*b* and the swingable bars 80*a*, 80*b* are normally held in engagement with the stopper pins 84*a*, 84*b* and the stopper pins 85*a*, 85*b* so that the swingable bars 80*a*, 80*b* are inclined at an angle $\theta°$, practically ranging from 5° to 45°, preferably 10°, in the direction A with respect to the vertical direction indicated by V in FIG. 7, which angle $\theta°$ is the same as the angle at which the sheet support 34 is inclined.

The swingable bars 80*a*, 80*b* have respective arcuate surfaces 86*a*, 86*b* at upper ends thereof which are engageable with outer circumferential surfaces of rollers or fixed pivot members 88*a*, 88*b* supported in the casing 12. A horizontally elongate swingable attachment member 90 is fixed to and extends between the lower ends of the swingable bars 80*a*, 80*b*.

Figure 6:
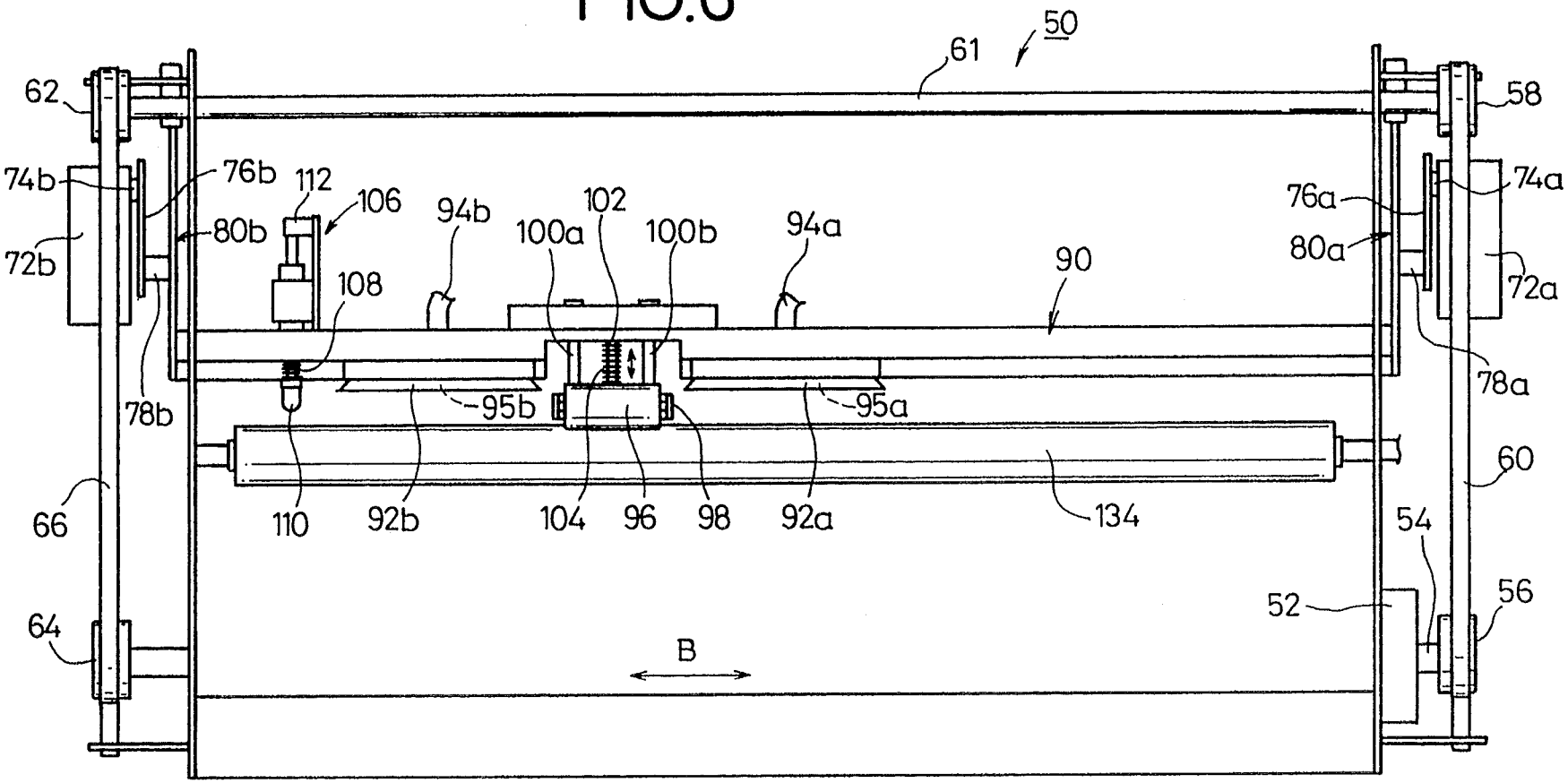
FIG. 6 is a front elevational view of the sheet feeding mechanism.

As illustrated in FIGS. 1 and 6, a pair of suction cups 92*a*, 92*b* elongate in the direction indicated by the arrow A, which is perpendicular to the direction A, is fixedly mounted on the attachment member 90. The suction cups 92*a*, 92*b*, which are direction generally downwardly, are connected to a vacuum generator (not shown) through respective tubes 94*a*, 94*b*. The suction cups 92*a*, 92*b* have small surface irregularities on their lower faces, i.e., respective roughened faces 95*a*, 95*b* of matt finish, for contacting a sheet S.

A press roller 96 is vertically movably mounted on the attachment member 90 between the suction cups 92*a*, 92*b*. The press roller 96 is rotatably supported on a support arm 98 supported on guide rods 100*a*, 100*b* that are vertically inserted through the attachment member 90. The press roller 96 is normally urged to move downwardly by a spring 104 disposed around a vertical rod 102 fixed to the support arm 98 and extending vertically through the attachment member 90. The spring 104 may be combined with a damper (not shown) for controlling vertical movement of the press roller 96.

A sheet surface detector 106 is mounted on the attachment member 90 closely to the suction cup 92*a*. The sheet surface detector 106 has a feeler rod 110 positioned below the attachment member 90 and biased downwardly by a spring 108, and a detector unit 112 such as a proximity sensor or the like triggerable by the feeler rod 110.

Figure 7:
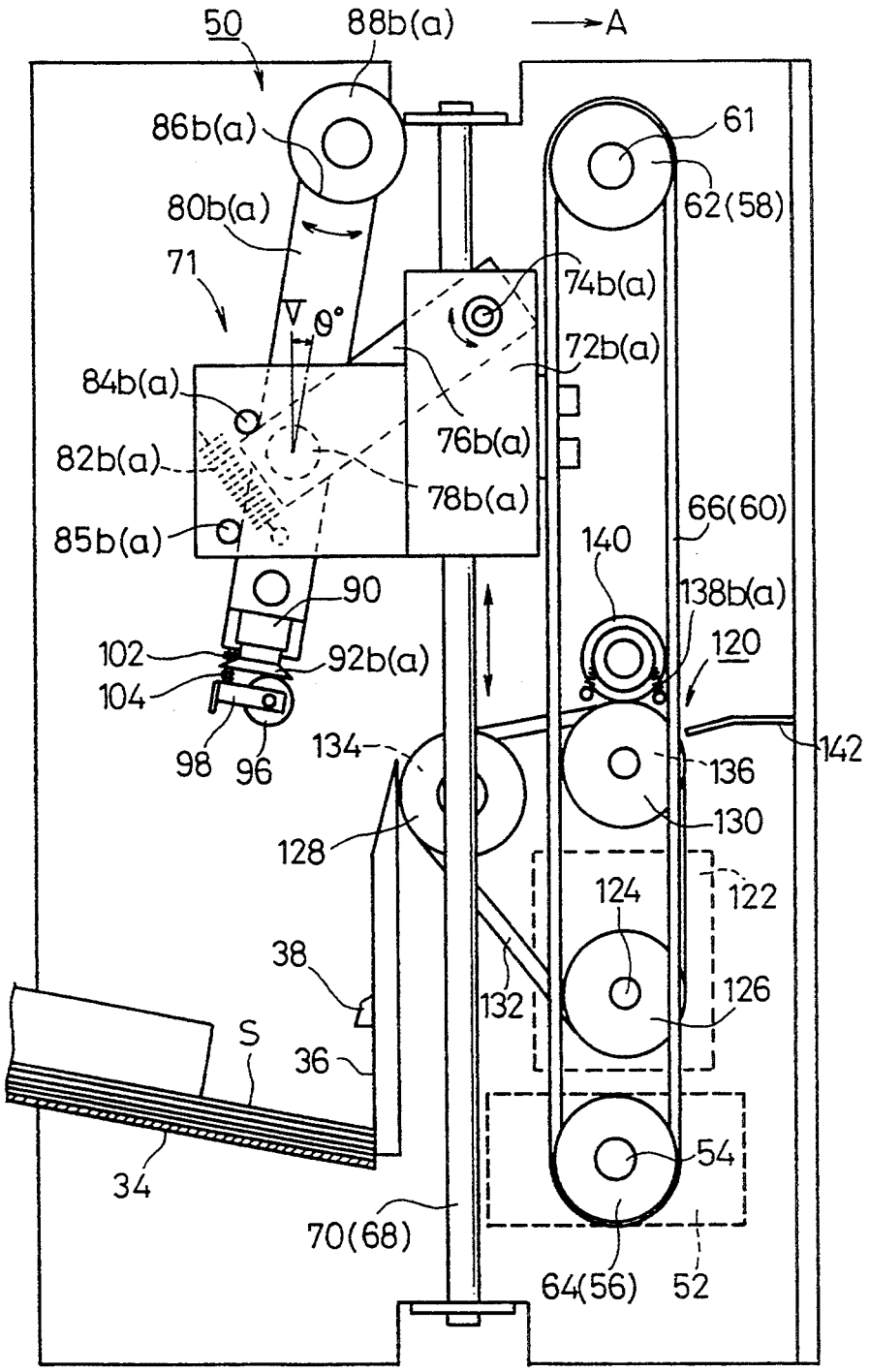
FIG. 7 is a side elevational view of the sheet feeding mechanism.
Figure 8:
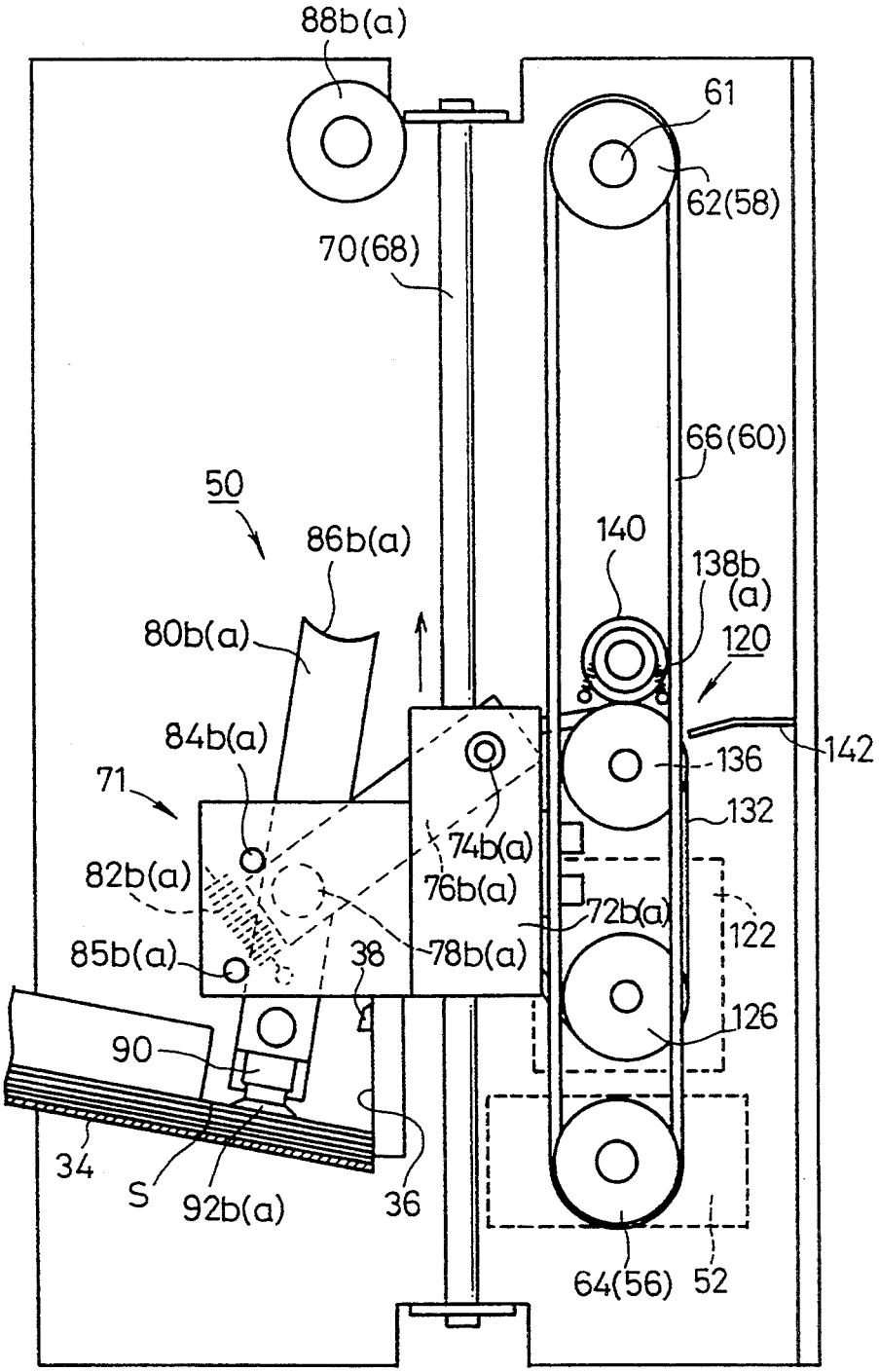
FIGS. 8 and 9 are side elevational views showing the manner in which the sheet feeding mechanism operates.
Figure 9:
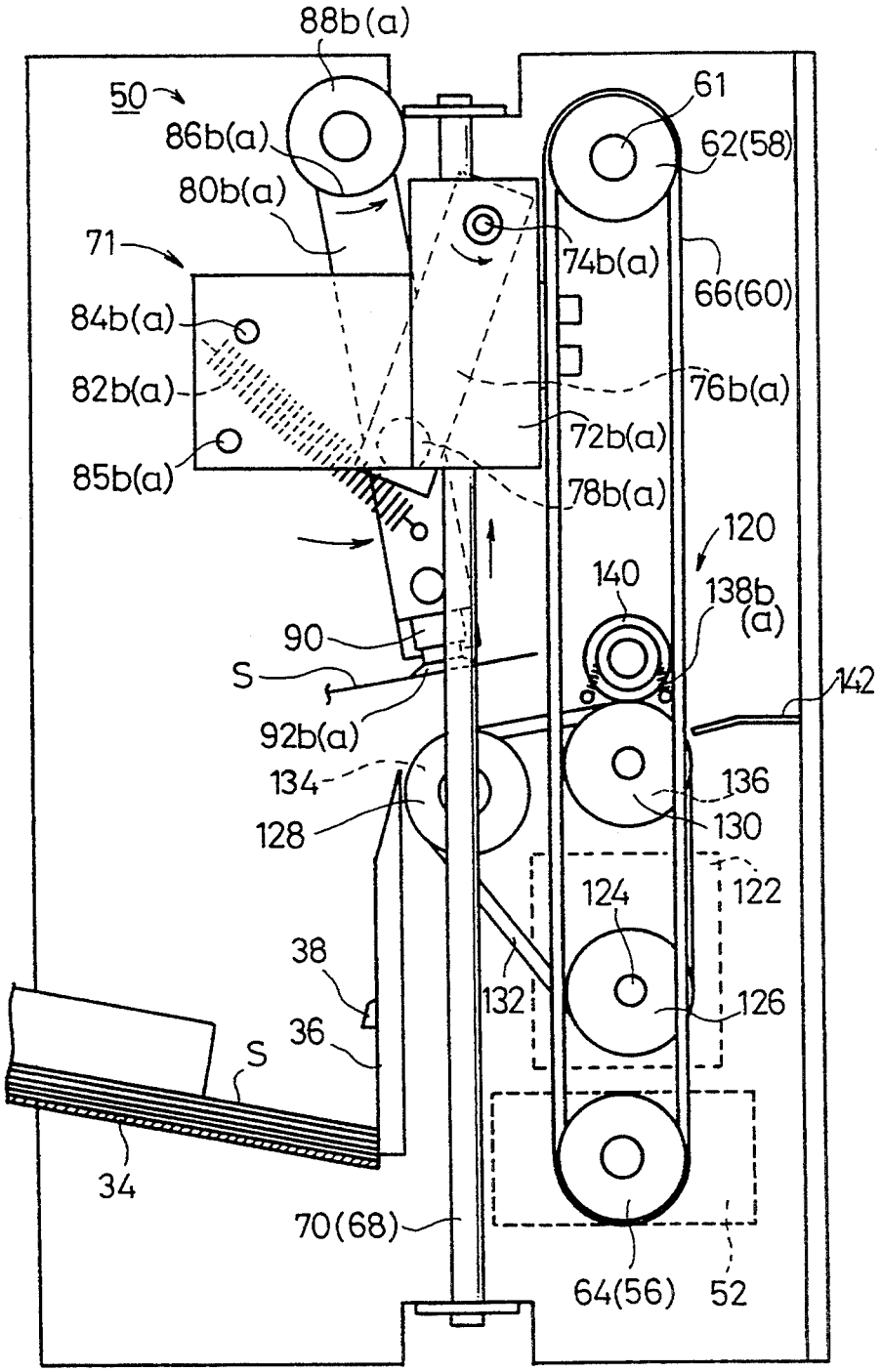

As shown in FIG. 3, a sheet delivery mechanism 120 is disposed in the vicinity of the sheet feeding mechanism 50. As shown in FIGS. 7 through 9, the sheet delivery mechanism 120 has a rotary actuator 122 having a rotatable shaft 124 to which a pulley 126 is fixed. An endless belt 132 is trained around the pulley 126 and other pulleys 128, 130. The pulley 128 is fixed to an end of a first feed roller 134, and the pulley 130 is fixed to an end of a second feed roller 136. A nip roller 140 is held in rolling contact with the second roller 136 under the bias of springs 138*a*, 138*b*.

Figure 10:
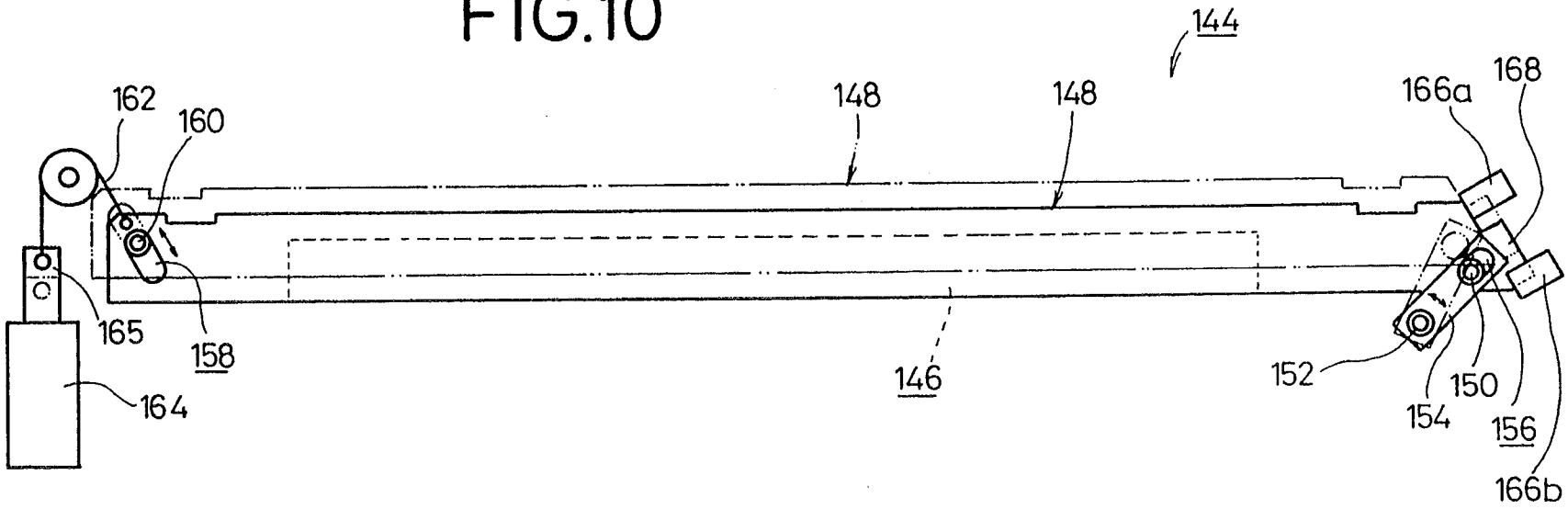
FIG. 10 is a front elevational view of a shutter mechanism of the automatic supply device.

A guide plate 142 is housed in the casing 12 near the second feed roller 136 for guiding a sheet S in the direction A. A shutter mechanism 144 (see FIG. 10) is positioned on an extension of the guide plate 142. As shown in FIG. 10, the shutter mechanism 144 comprises an opening and closing plate 148 for selectively opening and closing a horizontal sheet outlet slot 146 defined in a vertical panel of the casing 12. A pin 150 is secured to one end of the opening and closing plate 148, and received in an oblong hole 156 defined in an end of a link 154 that is swingably supported in the casing 12 by a pivot shaft 152. The other end of the opening and closing plate 148 has an oblong hole 158 defined therein which is inclined to the vertical direction. A guide pin 160 fixedly mounted in the casing 12 is fitted in the oblong hole 158. A wire 162 has an end anchored to the end of the opening and closing plate 148 near the oblong hole 158. The wire 162, which is looped around a pulley, has the other end fastened to a rod 165 extending upwardly from a solenoid 164. Two detectors 166*a*, 166*b* such as proximity sensors are mounted on the end of the opening and closing plate 148 near the pin 150. The detectors 166*a*, 166*b* are selectively triggerable by a trigger arm 168 on the same end of the opening and closing plate 148. When the opening and closing plate 148 is vertically moved, opening or closing the sheet outlet slot 146, the trigger arm 168 activates the detector 166*a* or 166*b* for thereby automatically detecting the opened or closed condition of the sheet outlet slot 146.

As shown in FIGS. 2 and 3, an LED display assembly 170 is mounted on an upper panel of the casing 12. The LED display assembly 170 has a pivotable LED support 174 projectably disposed in a recess 172 defined in the upper panel of the casing 12, a bar 176 joined to a rear end of the LED support 174, and springs 178*a*, 178*b* disposed around the bar 176 for normally urging the LED support 174 out of the recess 172. A latch 178 is mounted on the LED support 174 and an inner wall surface of the recess 172 for holding the LED support 174 in the recess 172. The LED support 174 supports thereon a pair of horizontally spaced LEDs (light-emitting diodes) 180*a*, 180*b*.

As shown in FIG. 3, the automatic supply device 10 is mounted on a mount base 202 of an automatic image developing apparatus 200. The mount base 202 has a sheet inlet slot 204 defined therein in communication with the sheet outlet slot 146 of the casing 12. The automatic image developing apparatus 200 has a pair of feed rollers 206 behind the sheet inlet slot 204 for feeding a sheet S that has been introduced from the automatic supply device 10 through the sheet outlet slot 146 and the sheet inlet slot 204.

Operation of the sheet feeding mechanism 50 in relation to the automatic supply device 10 will be described below.

First, the lock member 28 on the cover 14 is pressed by the operator to unlock the locking prong 30 from the locking prong 32 in a dark room. Then, the cover 14 is manually lifted by the operator, causing the attachment members 22 fixed to the cover 14 to turn clockwise (FIG. 3) about the pivot shaft 21. At this time, the pins 26 move from the solid-line position along the cam surfaces 18. When the pins 26 move past the cam lobes 18*a* of the cam surfaces 18, the cover 14 is biased to be opened upwardly under the forces of the springs 24. When the pins 26 slide into the respective locking recesses 18*b*, the cover 14 is held in the open position with the attachment members 22 in the two-dot-and-dash-line position.

A plurality of sheets S such as photographic films are stacked and positioned on the sheet support 34 by the positioning member 42*a*, for example. The operator adjusts the position of the sheets S on the sheet support 34, with his fingers, so that the corners Sa of the sheets S are located outwardly of the first angular profile wall 46*a* and within the width of the second angular profile wall 48*a*. As described above, the first angular profile wall 46*a* is positioned at dimensions smaller than those of the sheets S and the second angular profile wall 48*a* is lower than the first angular profile wall 46*a*. Therefore, the operator can easily confirm the position of the corners Sa of the sheets S with his fingers, and hence can position the sheets S on the sheet support 34 highly accurately and quickly.

After the sheets S have been stacked and positioned on the sheet support 34, the operator turns the cover 14 counterclockwise until it is fully closed over the sheet support 34. At this time, when the pins 26 on the attachment members 22 move along the cam surfaces 18 and past the cam lobes 18*a*, the cover 14 is biased to be closed under the forces of the springs 24, and hence can smoothly be closed.

If the sheets S as they are placed into the casing 12 are likely to be exposed to light from the LEDs 180*a*, 180*b*, then the LED support 174 of the LED display assembly 170 should manually be pressed into the recess 172 and latched in the recess 172 by the latch 179. Since the LEDs 180*a*, 180*b* are housed in the recess 172, there is no danger for the sheets S to be exposed to light from the LEDs 180*a*, 180*b*.

Then, the rotary actuator 52 of the sheet feeding mechanism 50 is energized to cause the rotatable shaft 54 to rotate the pulley 56. The timing belt 60 trained around the pulleys 56, 58 and the timing belt 66 trained around the pulleys 62, 64 are moved to lower the vertically movable bases 72*a*, 72*b* together. The swingable bars 80*a*, 80*b* and the attachment member 90 also descend until the feeler rod 110 of the sheet detector 106 abuts against the uppermost sheet S, whereupon the upper end of the feeler rod 110 triggers the detector unit 112 into operation. The detector unit 112 produces a signal which controls the rotary actuator 52 to lower the attachment member 90 at a lower speed. Therefore, when the press roller 96 and the suction cups 92*a*, 92*b* on the attachment member 90 engage the uppermost sheet S, no excessive forces are applied to the uppermost sheet S. The sheets S are thus prevented from developing a pressure-induced fog.

After the press roller 96 abuts against the uppermost sheet S upon descent of the attachment member 90, the suction cups 92*a*, 92*b* engage the uppermost sheet S, and the vacuum generator is actuated to cause the vacuum cups 92*a*, 92*b* to attract the uppermost sheet S as shown in FIG. 8. The rotary actuator 52 is now reversed to cause the vertically movable bases 72*a*, 72*b* to elevate the attachment member 90, so that the uppermost sheet S attracted by the suction cups 92*a*, 92*b* is lifted away from the sheet support 34.

As the attachment member 90 ascends, the press roller 96 moves downwardly with respect to the attachment member 90 under the bias of the spring 104. The sheet S is flexed downwardly by the press roller 96 between the suction cups 92*a*, 92*b*. As a result, a swinging motion is virtually imparted to the sheet S. Since the sheet support 34 is inclined at the angle $\theta°$ with respect to the horizontal direction and the leading ends of the sheets S on the sheet support 34 abut against the vertical wall 36, the leading ends of the sheets S are staggered respective distances depending on the respective thicknesses of the sheets S. The staggered sheets S can easily be separated from each other without sticking. The leading ends of the sheets S beneath the uppermost sheet S are engaged by the engaging prong 38 on the vertical wall 36. Accordingly, the sheets S are reliably prevented from being fed together from the sheet support 34.

Upon further upward movement of the attachment member 90 after the arcuate surfaces 86*a*, 86*b* engage the respective rollers 88*a*, 88*b*, the narrow plate members 76*a*, 76*b* coupled to the respective swingable bars 80*a*, 80*b* by the pins 78*a*, 78*b* swing downwardly about the pivot shafts 74*a*, 74*b*, as shown in FIG. 9. Therefore, the swingable bars 80*a*, 80*b* swing about the respective rollers 88*a*, 88*b* toward the sheet delivery mechanism 120 against the bias of the tension springs 82*a*, 82*b* for thereby feeding the leading end of the sheet S attracted by the suction cups 92*a*, 92*b* to a position in the vicinity of the first feed roller 134 (see FIG. 9).

When the suction cups 92*a*, 92*b* are then inactivated, the press roller 96 moves toward the first feed roller 134, nipping the leading end of the sheet S between the first feed roller 134 and the press roller 96. The rotary actuator 122 of the sheet delivery mechanism 120 is energized to cause the shaft 124 to rotate the pulley 126. The endless belt 132 is moved to rotate the pulleys 128, 130, which then rotate the first and second pulleys 134, 136*b* in synchronism with each other. The sheet S nipped between the first feed roller 134 and the press roller 96 is now fed a certain interval in the direction A, until its leading end is nipped between the second feed roller 136 and the nip roller 140. When the leading end of the sheet S is nipped between the second feed roller 136 and the nip roller 140, the sheet S is continuously fed in the direction A. Therefore, the sheet S is delivered from the sheet outlet slot 146 into the sheet inlet slot 204 of the automatic image developing apparatus 200 while being guided by the guide plate 142. When nipped by the feed rollers 206 in the automatic image developing apparatus 200, the sheet S is fed into the automatic image developing apparatus 200 in which any image on the sheet S is developed into a visible image.

While the image on the sheet S is being developed into a visible image, a gas is liable to be produced in the automatic image developing apparatus 200. To prevent such a gas from being introduced into the casing 12, the shutter mechanism 144 is actuated to close the sheet outlet slot 146. Specifically, the solenoid 164 is de-energized to displace the rod 165 upwardly. The end of the opening and closing plate 148 which is coupled to the wire 162 connected to the rod 165 is lowered and moved to the right in FIG. 10 while being guided by the oblong hole 158 and the guide pin 160. At the same time, the link 154 engaging the opposite end of the opening and closing plate 148 is angularly moved to the right. Therefore, the opening and closing plate 148 is translated downwardly to the right, closing the sheet outlet slot 146. The interior space of the casing 12 is now shielded from the automatic image developing apparatus 200.

Figure 11:
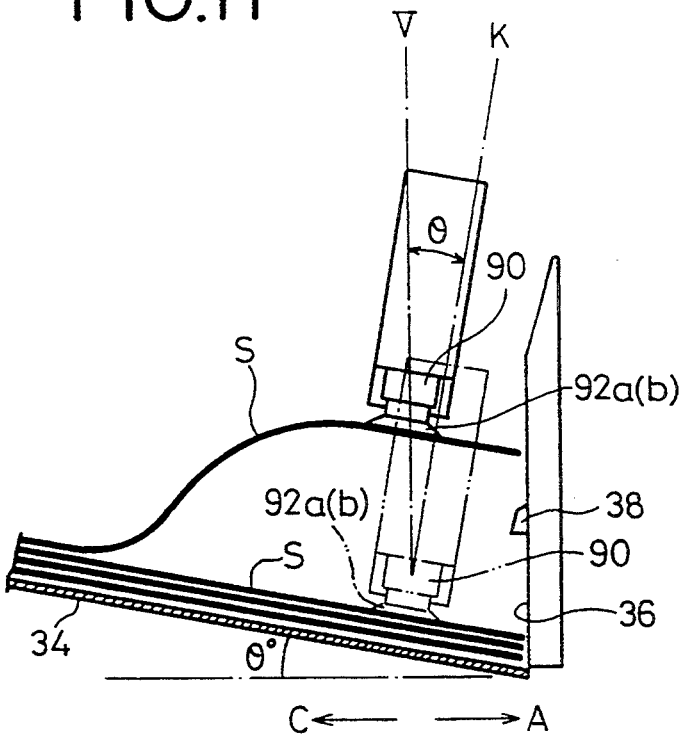
FIG. 11 is a view illustrative of a process of feeding sheets in the sheet feeding mechanism.

In the first embodiment, the sheet support 34 is inclined at the angle $\theta°$ to the horizontal direction, and the suction cups 92*a*, 92*b* for attracting one at a time of the sheets S stacked on the sheet support 34 are movable in the vertical direction V. Specifically, as shown in FIG. 11, the suction cups 92*a*, 92*b* are vertically movable up and down in the vertical direction V which is inclined through the angle $\theta°$ from a reference line K extending perpendicularly to the attracted surface of the uppermost sheet S, in a direction indicated by the arrow C which is opposite to the sheet feeding direction A in which the sheets S are to be fed one by one.

When the suction cups 92*a*, 92*b* attracting the uppermost sheet S move upwardly in the vertical direction V, the leading end of the uppermost sheet S which is attracted by the suction cups 92*a*, 92*b* is displaced toward the trailing end thereof, causing the uppermost sheet S to flex between the leading and trailing ends thereof. Therefore, simply when the suction cups 92*a*, 92*b* are vertically displaced, the sheet S attracted by the suction cups 92*a*, 92*b* is given a swinging motion, and can reliably be removed independently from the sheet stack on the sheet support 34. Plural sheets S are thus reliably and easily prevented from being removed simultaneously from the sheet stack.

The suction cups 92*a*, 92*b* are not required to move along an intricate path in order to impart a swinging motion to the sheets S. The sheet feeding mechanism 50 is relatively simple in structure, allowing the sheets S to be fed one by one highly efficiently.

In the first embodiment, the swingable bars 80*a*, 80*b* are mounted on the vertically movable bases 72*a*, 72*b*, and the suction cups 92*a*, 92*b* and the press roller 96 are mounted on the attachment member 90 that is fixed to the lower ends of the swingable bars 80*a*, 80*b*. When the suction cups 92*a*, 92*b* which attract the sheet S are angularly moved toward the sheet delivery mechanism 120 by the swingable bars 80*a*, 80*b*, the press roller 96 is also angularly moved in unison with the suction cups 92*a*, 92*b*. Therefore, as shown in FIG. 9, when the suction cups 92*a*, 92*b* are inactivated to release the sheet S after the suction cups 92*a*, 92*b* and the press roller 96 are positioned substantially above the first feed roller 134 of the sheet delivery mechanism 120 upon swinging movement of the swingable bars 80*a*, 80*b*, the press roller 96 projects toward the first feed roller 134, and the leading end of the sheet S is nipped between the press roller 96 and the first feed roller 134.

Unlike the conventional arrangement in which the sheet S is nipped between a pair of feed rollers, the suction cups 92*a*, 92*b* are not required to be controlled highly accurately in position, and the leading end of the sheet S can reliably be nipped between the first feed roller 134 and the press roller 96 even if the leading end of the sheet S is somewhat curled. Since a nip roller associated with a dedicated drive mechanism is not employed, the press roller 96 needs no dedicated drive mechanism, and hence the sheet feeding mechanism 50 is relatively simple and inexpensive.

In the first embodiment, furthermore, the press roller 96 is normally biased downwardly by the spring 104 disposed around the rod 102. When the suction cups 92*a*, 92*b* that have attracted the sheet S are elevated, the press roller 96 projects downwardly with respect to the attachment member 90 under the bias of the spring 104, flexing the sheet S downwardly between the suction cups 92*a*, 92*b*. The sheet S held by the suction cups 92*a*, 92*b* is therefore given a virtual swinging motion, so that a plurality of sheet S are prevented from being fed simultaneously from the sheet stack.

Inasmuch as the swingable bars 80*a*, 80*b* are swingable about the rollers 88*a*, 88*b* fixedly mounted in the casing 12, the suction cups 92*a*, 92*b* can easily and reliably be moved to a desired position.

The suction cups 92*a*, 92*b* have the respective roughened faces 95*a*, 95*b* of matt finish for contacting the sheet S. Since the roughened faces 95*a*, 95*b* of matt finish have a reduced surface area for contacting the sheet S, the amount of static electricity developed when the sheet S is released from the suction cups 92*a*, 92*b* is greatly reduced, making it possible to prevent static marks from being applied to the sheet S.

A sheet feeding mechanism according to a second embodiment of the present invention will now be described below.

Figure 13:
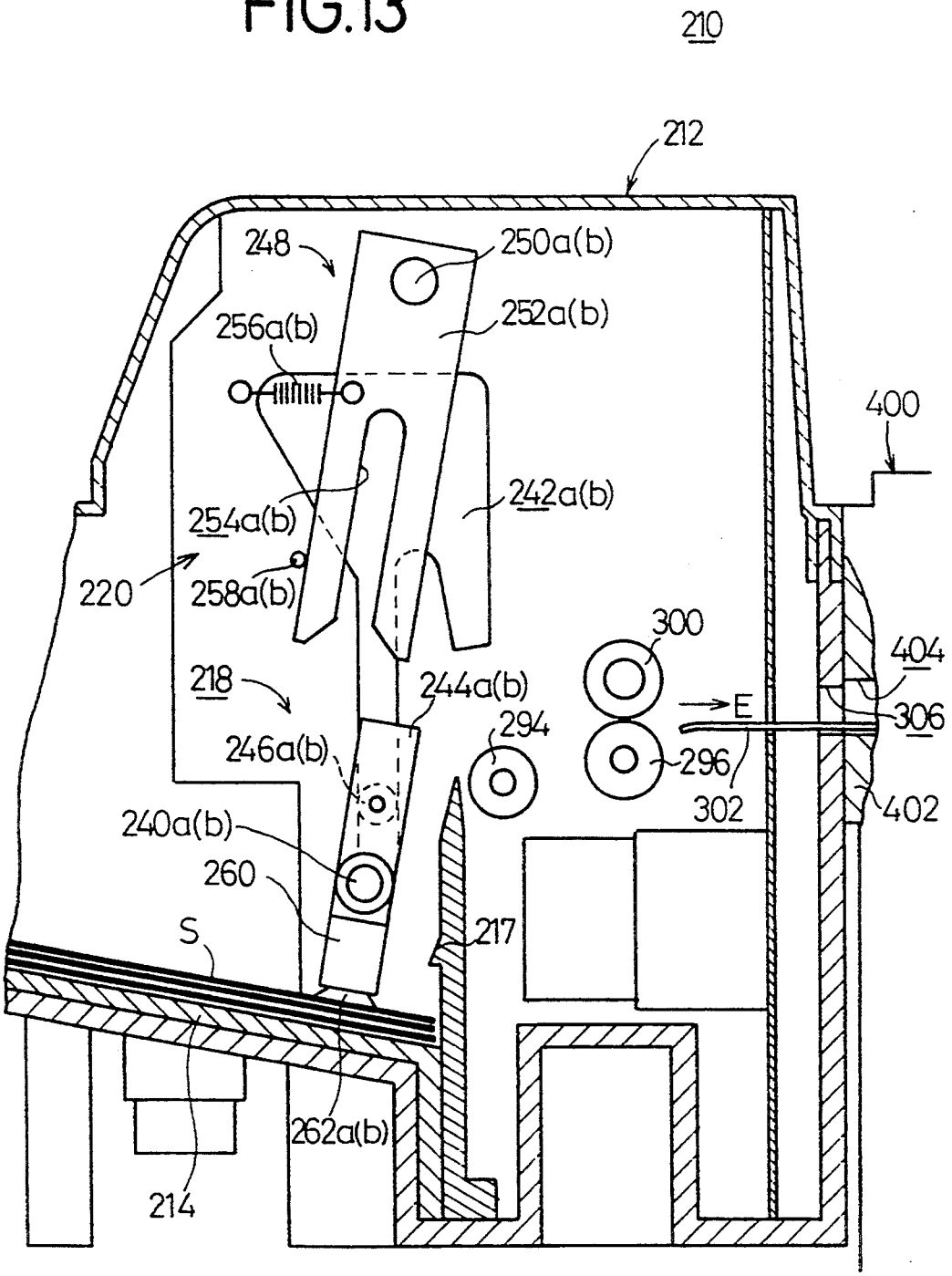
FIG. 13 is a vertical cross-sectional view of an automatic supply device which incorporates the sheet feeding mechanism shown in FIG. 12.

FIG. 13 shows an automatic supply device 210 which incorporates a sheet feeding mechanism according to a second embodiment of the present invention. The automatic supply device 210 has a casing 212 with a sheet support 214 on a bottom thereof. The sheet support 214 supports thereon a stack of sheets S such as photosensitive sheets. A prong 217 is positioned forwardly and upwardly of the sheet support 214 for separating the leading ends of the sheets S to prevent plural sheets S from being simultaneously removed from the sheet stack.

The casing 212 houses a pair of laterally spaced attachment plates 220. A sheet feeding mechanism 218 of the second embodiment has a rotary actuator 222 (see FIG. 14) fixedly mounted on one of the attachment plates 220. The rotary actuator 222 has a rotatable shaft 224 with a pulley 226 secured thereto. A timing belt 230 is trained around the pulley 226 and pulleys 228*a*, 228*b* which are positioned substantially above and below, respectively, the pulley 226. The pulley 228*b* is fixed to an end of a rotatable shaft 232 whose other end supports a pulley 234*b*. Another timing belt 238, which extends parallel to the timing belt 230, is trained around the pulley 234*b* and pulleys 234*a*, 236.

Engaging rods 240*a*, 240*b* are fixed to the timing belts 230, 238, respectively. The engaging rods 240*a*, 240*b* extend through respective guide grooves 242*a*, 242*b* defined respectively in the attachment plates 220, and have ends rotatably supported on respective support bars 244*a*, 244*b*. The guide grooves 242*a*, 242*b* serve to guide rollers 246*a*, 246*b* rotatably mounted on the respective support bars 244*a*, 244*b*. The guide grooves 242*a*, 242*b* have a width corresponding to the diameter of the guide rollers 246*a*, 246*b*. The guide grooves 242*a*, 242*b* extend vertically along the timing belts 230, 238, respectively. The guide grooves 242*a*, 242*b* have upper ends spreading near the respective pulleys 228*a*, 234*a* and lower ends terminating at a certain height along the timing belts 230, 238. The guide grooves 242*a*, 242*b* and the guide rollers 246*a*, 246*b* jointly constitute a guide assembly 241.

Attitude keepers 248 for holding suction cups 262*a*, 262*b* (described later on) in a desired attitude are mounted on the respective attachment plates 220 above the spreading upper ends of the guide grooves 242*a*, 242*b*. The attitude keepers 248 have respective swingable bars 252*a*, 252*b* swingably supported on the attachment plates 220 by respective pivot shafts 250*a*, 250*b*. The swingable bars 252*a*, 252*b* have slots or openings 254*a*, 254*b*, respectively, extending longitudinally from a substantially intermediate portion to an end thereof. The openings 254*a*, 254*b* have a width large enough to receive the respective guide rollers 246*a*, 246*b*. The open ends of the openings 254*a*, 254*b* have outwardly tapered surfaces for guiding the guide rollers 246*a*, 246*b* into the openings 254*a*, 254*b*. The swingable bars 252*a*, 252*b* are normally kept in abutment against respective stopper pins 258*a*, 258*b* by tension springs 256*a*, 256*b*. With the swingable bars 252*a*, 252*b* abutting against the stopper pins 258*a*, 258*b*, the openings 254*a*, 254*b* are substantially aligned with the respective guide grooves 242*a*, 242*b*.

Figure 12:
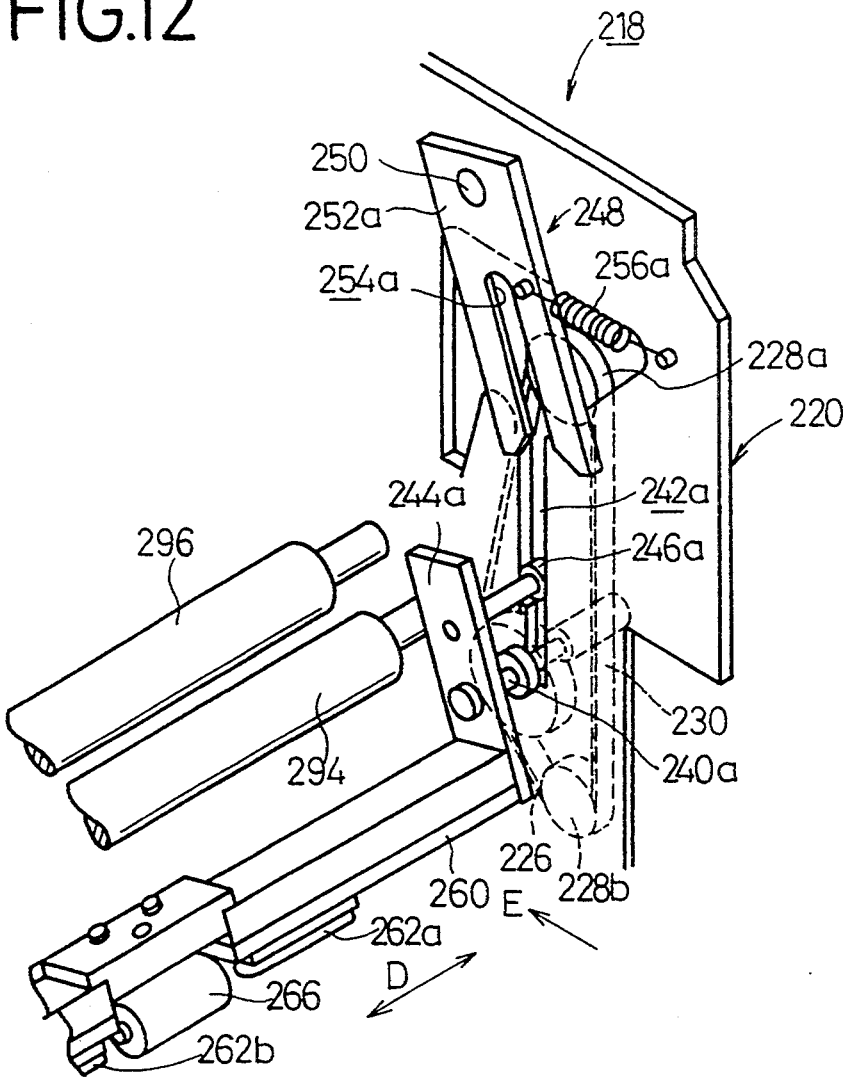
FIG. 12 is a fragmentary perspective view of a sheet feeding mechanism according to a second embodiment of the present invention.
Figure 15:
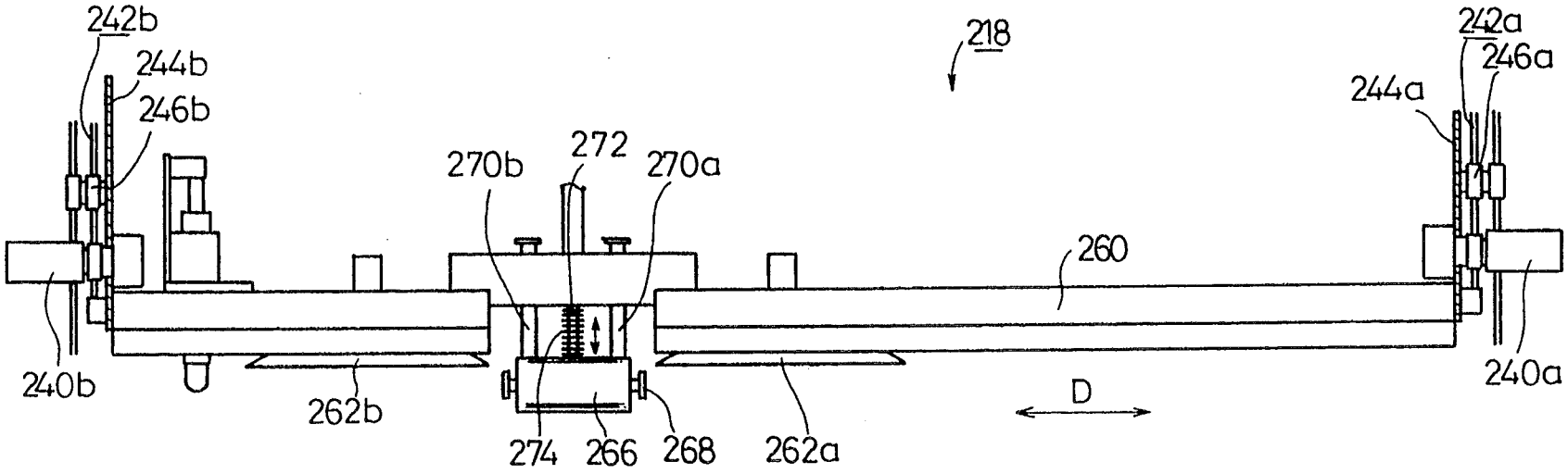
FIG. 15 is a front elevational view of the sheet feeding mechanism according to the second embodiment.

A horizontally elongate attachment member (swingable member) 260 has opposite ends fixed to the respective support bars 244*a*, 244*b*. As shown in FIGS. 12 and 15, the attachment member 260 supports thereon a pair of spaced suction cups 262*a*, 262*b* each elongate in a direction indicated by the arrow D which is normal to the direction indicated by the arrow E in which the sheets E are fed. The suction cups 262*a*, 262*b* are connected to a vacuum generator (not shown). A press roller 266 is vertically movably mounted on the attachment member 260 between the suction cups 262*a*, 262*b*. The press roller 266 is rotatably supported on a support arm 268 supported on guide rods 270*a*, 270*b* that are vertically inserted through the attachment member 260. The press roller 266 is normally urged to move downwardly by a spring 274 disposed around a vertical rod 272 fixed to the support arm 268 and extending vertically through the attachment member 260.

Figure 14:
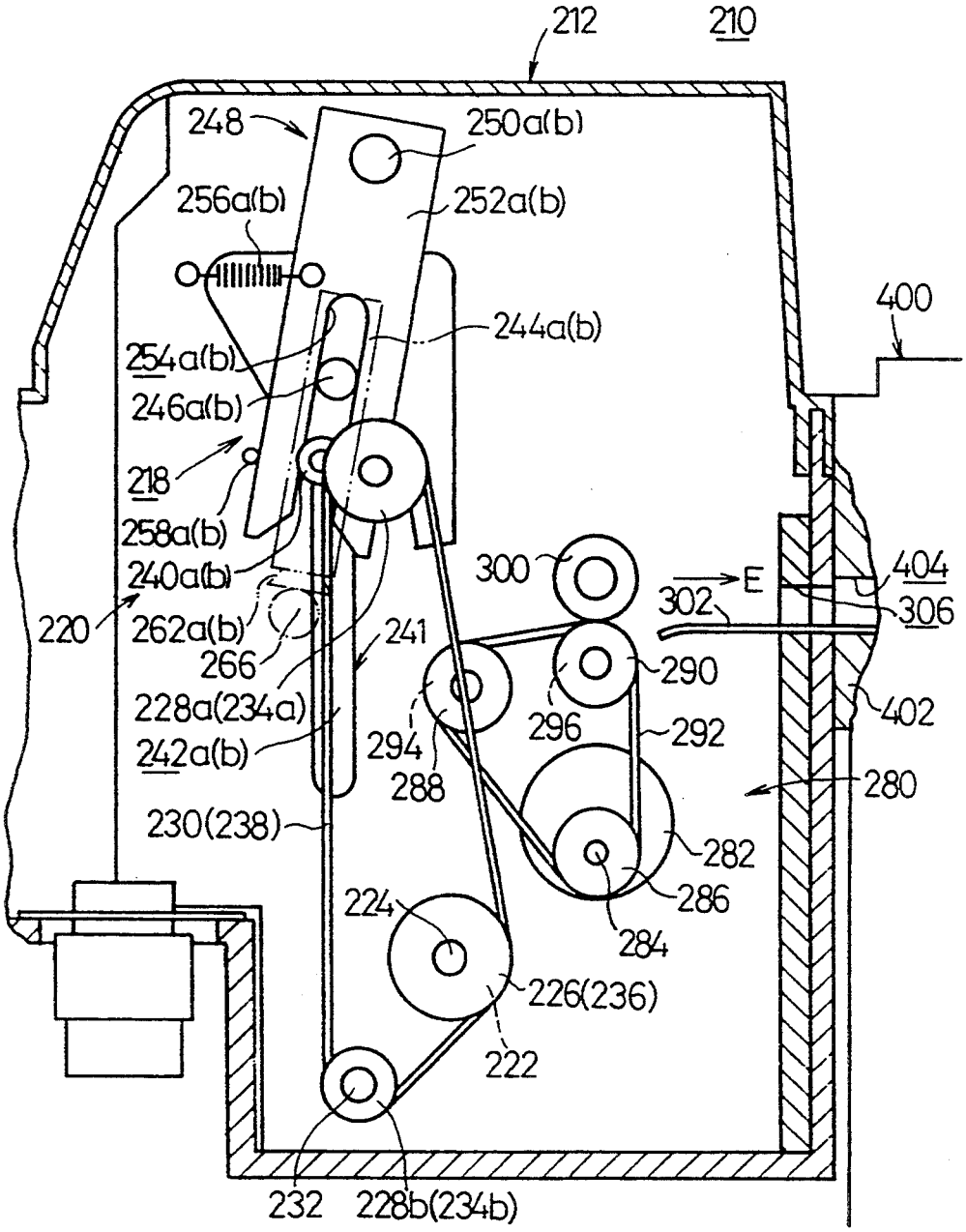
FIG. 14 is a vertical cross-sectional view of a drive system of the automatic supply device shown in FIG. 13.

As shown in FIG. 14, a sheet delivery mechanism 280 is disposed in the vicinity of the sheet feeding mechanism 218. The sheet delivery mechanism 280 has a rotary actuator 282 having a rotatable shaft 284 to which a pulley 286 is fixed. An endless belt 292 is trained around the pulley 286 and other pulleys 288, 290. The pulley 288 is fixed to an end of a first feed roller 294, and the pulley 290 is fixed to an end of a second feed roller 296. A nip roller 300 is held in rolling contact with the pulley 296 under the bias of springs (not shown).

A guide plate 302 is housed in the casing 212 near the second feed roller 296 for guiding a sheet S in the direction E. A sheet outlet slot 306 is defined in a vertical wall of the casing 212 on an extension of the guide plate 302.

The automatic supply device 210 is mounted on a mount base 402 of an automatic image developing apparatus 400. The mount base 402 has a sheet inlet slot 404 defined therein in communication with the sheet outlet slot 306 of the casing 212.

The sheet feeding mechanism 218 operates as follows:

With the automatic supply device 210 mounted on the mount base 402 of the automatic image developing apparatus 400, a stack of sheets S is placed on the sheet support 214 in the automatic supply device 210. When the rotary actuator 222 of the sheet feeding mechanism 218 is energized, the rotatable shaft 224 rotates the pulley 226, causing the timing belts 230, 238 to lower the engaging rods 240*a*, 240*b* in unison with each other. The support bars 244*a*, 244*b* engaging the engaging rods 240*a*, 240*b* lower the attachment member 260. First, the press roller 266 abuts against the uppermost sheet S of the sheet stack, and then the suction cups 262*a*, 262*b* engage the uppermost sheet S. The non-illustrated vacuum generator is actuated to cause the suction cups 262*a*, 262*b* to attract the uppermost sheet S.

The rotary actuator 222 is then reversed to lift the attachment member 260 to remove the uppermost sheet S attracted by the suction cups 262*a*, 262*b* away from the sheet support 214. The attachment member 260 is guided to ascend in a predetermined attitude along a predetermined path by the guide assembly 241, i.e., the guide rollers 246*a*, 246*b* on the support bars 244*a*, 244*b* and the guide grooves 242*a*, 242*b* in the attachment member plates 220.

Figure 16:
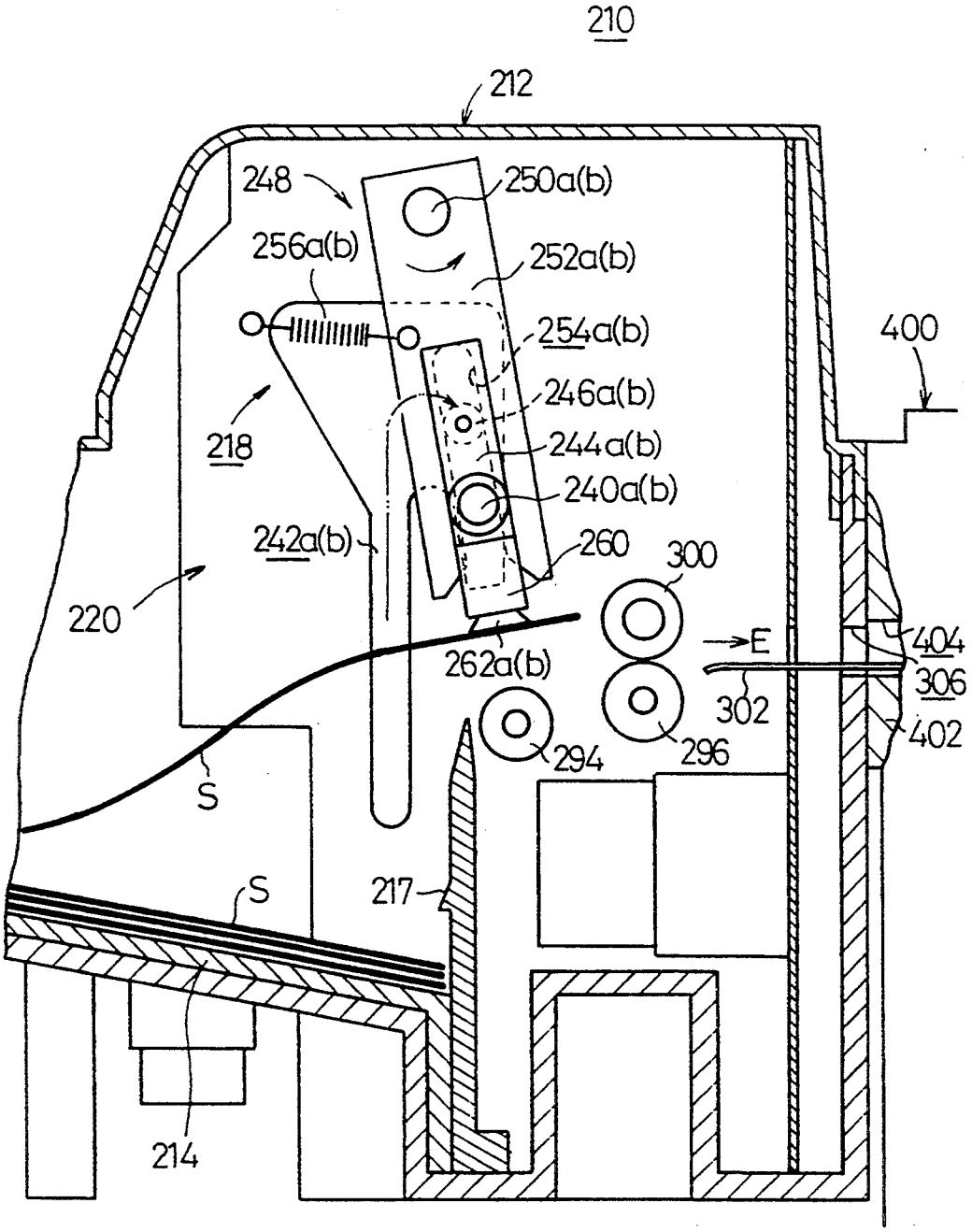
FIGS. 16 and 17 are vertical cross-sectional views illustrating the manner in which the sheet feeding mechanism according to the second embodiment operates.

Upon further upward movement of the attachment member 260, the guide rollers 246*a*, 246*b* are fitted into the respective openings 254*a*, 254*b* of the swingable bars 252*a*, 252*b*. Therefore, the support bars 244*a*, 244*b* are prevented from being turned upside down in a position beyond the pulleys 228*a*, 234*a*. Specifically, the guide rollers 246*a*, 246*b* positioned above the engaging rods 240*a*, 240*b* are fitted in the respective openings 254*a*, 254*b* and turn the swingable bars 252*a*, 252*b* to the right in FIG. 16 against the bias of the tension springs 256*a*, 256*b*. Therefore, the engaging rods 240*a*, 240*b* moving with the timing belts 230, 238 are always positioned below the guide rollers 246*a*, 246*b*, preventing the support bars 244*a*, 244*b* from being turned upside down.

Figure 17:
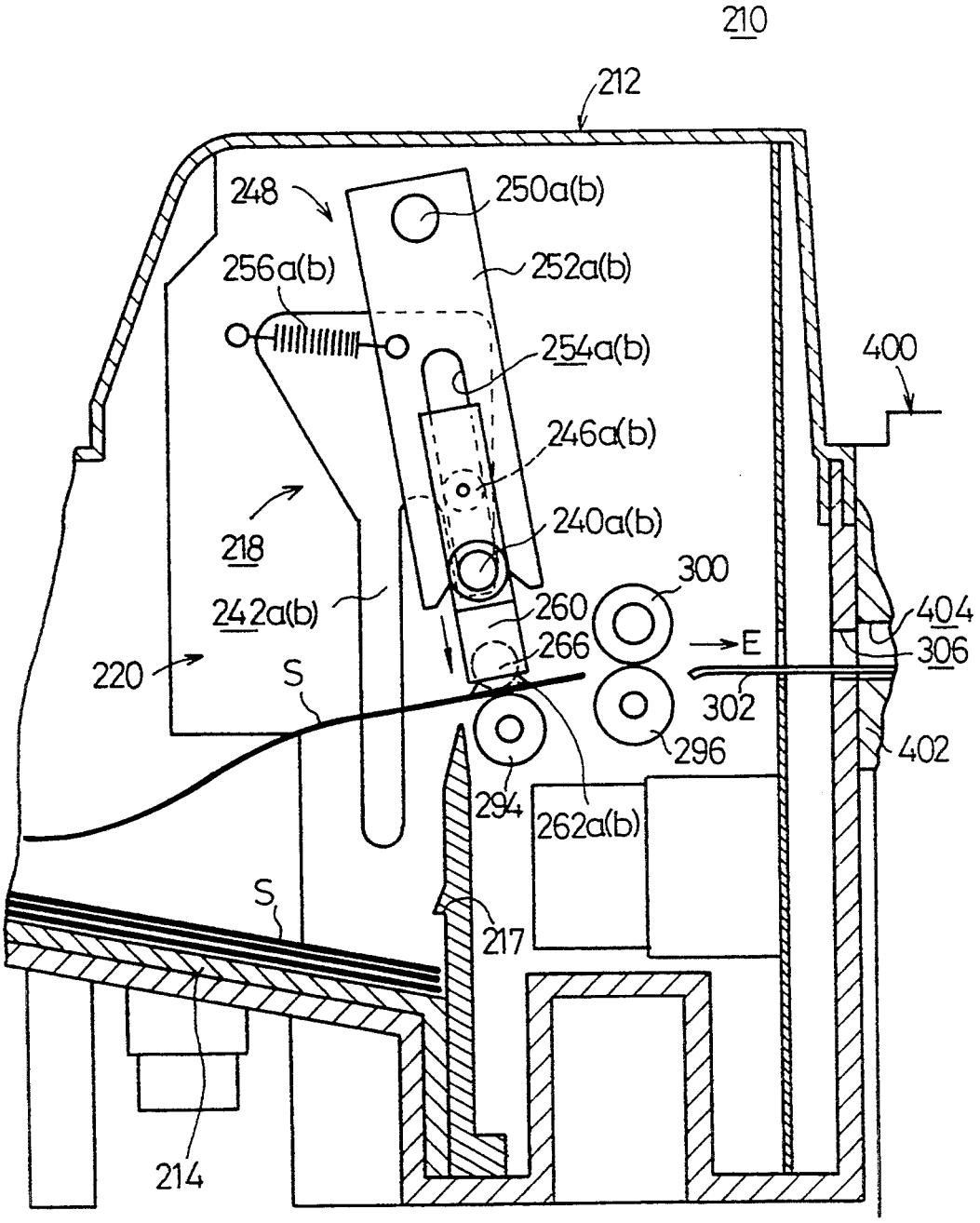

The suction cups 262*a*, 262*b* which attract the sheet S pass through an uppermost position corresponding to the upper portions of the outer circumferential surfaces of the pulleys 228*a*, 234*a*, and then descend toward the first feed roller 294. The sheet S attracted by the suction cups 262*a*, 262*b* abuts against the first feed roller 294. After the leading end of the sheet S is nipped between the press roller 266 and the first feed roller 294 (see FIG. 17), the suction cups 262*a*, 262*b* are inactivated to release the sheet S, and then lifted away from the sheet S, leaving the press roller 266 in contact with the sheet S.

With the leading end of the sheet S being nipped between the press roller 266 and the first feed roller 294, the rotary actuator 282 of the sheet delivery mechanism 280 is energized to rotate the shaft 284 and the pulley 286. The endless belt 292 and the pulleys 288, 290 now cause the first and second feed rollers 294, 296 to rotate in synchronism with each other. The sheet S nipped between the press roller 266 and the first feed roller 294 is fed a certain distance in the direction E, and thereafter the leading end of the sheet S is nipped between the second feed roller 296 and the nip roller 300, which feed the sheet S further in the direction E. The sheet S is guided by the guide plate 302 from the sheet outlet slot 306 into the sheet inlet slot 404 of the automatic image developing apparatus 400 in which any image on the sheet S is developed into a visible image.

In the second embodiment, as described above, after the sheet S as it is attracted by the suction cups 262*a*, 262*b* is nipped between the press roller 266 and the first feed roller 294, the sheet S is released from the suction cups 262*a*, 262*b*. Consequently, the sheet S fed by the sheet feeding mechanism 218 can be transferred reliably and highly accurately from the suction cups 262*a*, 262*b* to the first feed roller 294. The sheets S can thus be fed one by one smoothly and efficiently.

After the sheet S attracted by the suction cups 262*a*, 262*b* has been fed to the sheet delivery mechanism 280, the rotary actuator 222 is reversed to lift the attachment member 260 while it is being guided by the openings 254*a*, 254*b* and the guide rollers 246*a*, 246*b*. The attachment member 260 is then guided to descend toward the sheet support 214 by the guide grooves 242*a*, 242*b* and the guide rollers 246*a*, 246*b*. The next sheet S on the sheet support 214 is then attracted by the suction cups 262*a*, 262*b*, and fed in the same manner as described above for transfer from the sheet delivery mechanism 280 to the automatic image developing apparatus 400.

The sheet feeding mechanism according to the present invention and the above process of feeding sheets with the sheet feeding mechanism offer the following advantages:

The suction cups that have attracted the uppermost sheet are moved while they are being inclined through a certain angle from the direction perpendicular to the sheet to a direction opposite to the direction in which the sheet is fed. Therefore, the leading end of the sheet attracted by the suction cups is displaced toward the trailing end thereof, so that the sheet is flexed between its leading and trailing ends. Simply by displacing the suction cups, therefore, the sheet held by the suction cups is given a swinging motion. Plural sheets are thus reliably and easily prevented from being fed simultaneously. The suction cups are not required to move along an intricate path. Consequently, the sheet feeding mechanism is relatively simple in structure, and can feed sheets one by one quickly and efficiently.

Furthermore, since the suction cups that have attracted the uppermost sheet are moved toward the sheet delivery mechanism by the attachment member, the sheet is quickly and reliably nipped between the feed roller of the sheet delivery mechanism and the press roller on the attachment member. The sheet feeding mechanism is thus capable of feeding sheets one by one efficiently.

Although certain preferred embodiments of the present invention have been shown and described in detail, it should be understood that various changes and modifications may be made therein without departing from the scope of the appended claims.

What is claimed is:

1. A mechanism for feeding sheets one by one from a stack of sheets to a sheet delivery mechanism, comprising:

suction means for attracting an uppermost sheet of the stack;

moving means for moving said suction means which attracts said uppermost sheet in a direction inclined a predetermined angle from a direction perpendicular to the uppermost sheet opposite to a sheet feeding direction, wherein said moving means comprises a movable base moving up and down in the direction in which said moving means moves said suction means and a swingable member swingably mounted on said movable base, for holding said suction means with a suction face thereof lying parallel to said uppermost sheet; and transferring means for transferring said uppermost sheet removed from the stack to said sheet delivery mechanism in the sheet feeding direction, wherein said transferring means comprises a press roller mounted on said swingable member, in which said press roller moves in unison with said suction means and nips and delivers the uppermost sheet in cooperation with a feed roller of the sheet delivery mechanism.

2. A mechanism according to claim 1, wherein said transferring means further comprises an urging member for pressing said press roller against the sheet, said press roller being movable toward the attracted sheet beyond a suction face of said suction means.

3. A mechanism according to claim 1, wherein said transferring means further comprises a fixed pivot member engageable with an end of said swingable member to cause said swingable member to swing thereabout toward the sheet delivery mechanism upon movement of said movable base.

4. A mechanism for feeding sheets one by one from a stack of sheets to a sheet delivery mechanism, comprising:

suction means for attracting an uppermost sheet of the stack;

moving means for moving said suction means which attracts said uppermost sheet in a direction inclined a predetermined angle from a direction perpendicular to the uppermost sheet toward opposite to a sheet feeding direction, wherein said moving means comprises an attachment member movable between the stack of sheets and the sheet delivery mechanism, to which said suction means is mounted and guide means for guiding said attachment member along a predetermined path; and transferring means for transferring said uppermost sheet removed from the stack to said sheet delivery mechanism in the sheet feeding direction, wherein said transferring mechanism comprises a press roller which is mounted on said attachment member and is movable in unison with said suction means to nip and deliver the uppermost sheet in cooperation with a feed roller of the sheet delivery mechanism and attitude keeping means for holding said attachment member in a predetermined attitude with respect to said guide means to guide the uppermost sheet attracted by said suction means to a position in which the uppermost sheet can be nipped by said press roller and said feed roller.

5. A mechanism according to claim 4, wherein said guide means comprises:

a guide roller supported on said attachment member; and a guide groove in which said guide roller is inserted, and wherein said attitude keeping means comprises a swingable bar having an opening for guiding said guide roller as it moves along said guide groove.

6. A mechanism for feeding sheets one by one from a stack of sheets to a sheet delivery mechanism, comprising:

suction means for attracting an uppermost sheet of the stack;

moving means for moving said suction means which attracts said uppermost sheet;

transferring means for transferring said uppermost sheet attracted by said suction means to said sheet delivery mechanism; and a press roller which moves in unison with said suction means and nips and delivers the uppermost sheet in cooperation with a feed roller of the sheet delivery mechanism.

7. A mechanism according to claim 6, wherein said transferring means further comprises an urging member for pressing said press roller against the sheet, said press roller being movable toward the attracted sheet beyond a suction face of said suction means.

8. A mechanism according to claim 6, wherein said moving means comprises:

an attachment member movable between the stack of sheets and the sheet delivery mechanism, to which said suction means is mounted; and guide means for guiding said attachment member along a predetermined path.

9. A mechanism according to claim 8, wherein said transferring mechanism comprises:

a press roller which is mounted on said attachment member and is movable in unison with said suction means to nip and deliver the uppermost sheet in cooperation with a feed roller of the sheet delivery mechanism; and attitude keeping means for holding said attachment member in a predetermined attitude with respect to said guide means to guide the uppermost sheet attracted by said suction means to a position in which the uppermost sheet can be nipped by said press roller and said feed roller.

10. A mechanism according to claim 9, wherein said guide means comprises:

a guide roller supported on said attachment member; and a guide groove in which said guide roller is inserted, and wherein said attitude keeping means comprises a swingable bar having an opening for guiding said guide roller as it moves along said guide groove.

11. A mechanism according to claim 6, wherein said suction means comprises a suction cup, said suction cup having a roughened face of matt finish for contacting and attracting the sheet.

* * * * *